428-919
12/27/83 XR 4,423,104
SR

United States Patent [19]
Pusch et al.

[11] 4,423,104
[45] Dec. 27, 1983

[54] WIDE-BAND CAMOUFLAGE NETTING

[76] Inventors: Günter Pusch, Bannholziveg 12, 6903—Neckargemünd—2;
Dieter Aisslinger, Heidestr. 54, 6222—Geisenheim;
Alexander Hoffmann, Schlosstr. 32, 6909—Rotenberg, all of Fed. Rep. of Germany

[21] Appl. No.: 201,370

[22] Filed: Oct. 27, 1980

[30] Foreign Application Priority Data

Oct. 26, 1979 [DE] Fed. Rep. of Germany ..... 2943430

[51] Int. Cl.[3] ..... B32B 3/06
[52] U.S. Cl. ..... 428/101; 428/224; 428/229; 428/231; 428/247; 428/255; 428/257; 428/919
[58] Field of Search ..... 428/105, 107, 109, 110, 428/115, 247, 255, 919, 224, 225, 223, 257, 101, 229, 231

[56] References Cited

U.S. PATENT DOCUMENTS 3,013,588 12/1961 Klingberg ..... 428/225
3,977,927 8/1976 Amos et al. ..... 428/919

FOREIGN PATENT DOCUMENTS 554069 7/1952 Fed. Rep. of Germany .
1094163 12/1960 Fed. Rep. of Germany .
1840330 10/1961 Fed. Rep. of Germany .
1847355 2/1962 Fed. Rep. of Germany .
1133281 7/1962 Fed. Rep. of Germany .
539547 9/1941 United Kingdom ..... 428/919
1124956 8/1968 United Kingdom .
1404121 8/1975 United Kingdom .

*Primary Examiner*—James J. Bell
*Attorney, Agent, or Firm*—Michael N. Meller

[57] ABSTRACT

A camouflage net with two or more layers of a carrier net having garnishing stretch fabric material thereon so spread out as to prevent any radiation perpendicular to said net from penetrating the same. The spacing of the layers held together by tapes and cords are determined by the length of said tapes and cords.

9 Claims, 3 Drawing Figures

WIDE-BAND CAMOUFLAGE NETTING

Figure 1:
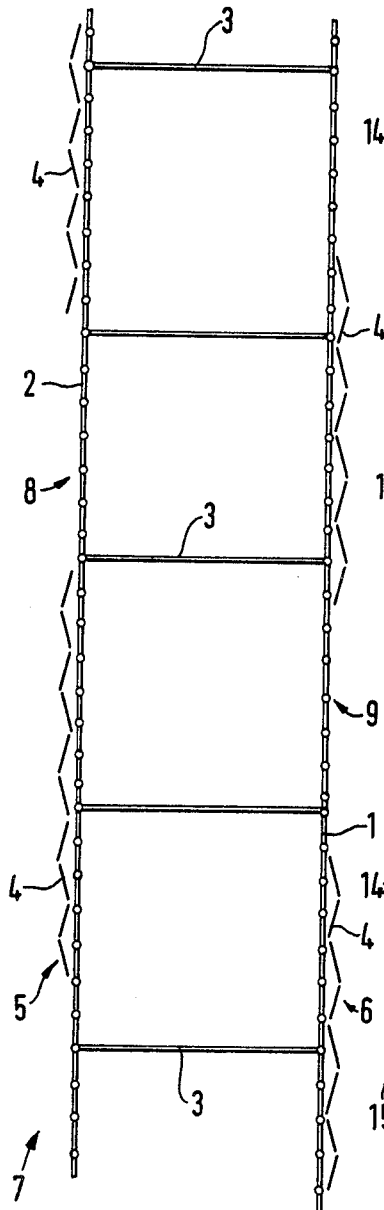

The invention relates to spectrally wide-band camouflage netting with random pieces of stretch fabric trim material.

Known camouflage netting consists of cut planar material fastened in strips or spots by suitable fixing means to a support net. There is also camouflage netting consisting of self-supporting knits or Raschel fabrics. The degree of covering of such netting is in the range of 50% to 80%. If a higher degree of covering is desired, several such nets may be superposed.

The adaptation of a camouflaging means to the natural environment, i.e. the imitation of nature, most frequently takes place at the edge of a group of trees or shrubs or of a wood.

In addition to the characteristic values of the spectral reflectivity, color saturation and mattness over a wide spectral range, the shapes of the individual spots also assume an important role. The most difficult problem is in imitating the gaps occurring in the natural growth, for instance between the individual branches.

Especially as regards observation from large distances, such gaps are successfuly imitated by a matt black color within the spectral range of $\lambda=0.4$ microns to 2.5 microns.

Regarding the spectral range of the thermal inherent radiation (TIR) in particular the ranges of the atmospheric windows at $\lambda=3$ microns to 5 microns and $\lambda=8$ microns to 14 microns, this problem cannot be solved by dyeing alone, as in this case both the emission from the natural gray body radiation and the spectral reflectance of environmental radiation are significant.

The most adverse weather for TIR camouflage is a clear sky and any sunshine.

It is therefore the object of the present invention to create spectrally wide-band camouflage netting which better simulates the natural conditions.

This problem is solved on the basis of wide-band camouflage netting of the initially cited kind in such a manner that the trim material is spread out in two or more planes and in that provision is made on these planes both of areas covered with trim and free of it.

It is essential that none of these planes shall be completely covered, rather that the total covering be distributed over the different planes. Large bare areas are present in each plane. The shape of these bare area is adapted to the shape of the gaps occurring in a wood of trees.

The stretch fabric trim material may be fixed to at least two support nets, either on or between them. Again the trim material may be made to be self-supporting in the particular planes. The separation between the planes of the support nets—or, if self-supporting trim is used, between the planes of the trim—can be secured by means of tapes or cords connecting the planes of the support nets or the planes of the trim, whereby these planes can be only apart a maximum distance. The connecting tapes or cords however may be made of an elastic, yielding material.

In order to prevent the thermal radiation from the camouflaged target from being transmitted through the gaps in the trim planes, the trim material is so distributed in these planes that any direction of observation whereby the target might be revealed falls on at least one layer of dense trim material.

This requirement is met for instance by tensioning from all the edges of an area bare of trim in one plane toward the edges of the trim covered area in the plane below. However this total solution is very costly and basically not required.

The distance between the individual layers should be adapted to the width of the trim-free areas, so that both solar radiation and the radiation sources from the clear sky shall project shadows of a size similar to the bare areas. This is achieved empirically with a ratio of the spacing of two bare planes to the width of the gaps in this plane or position being at least 1/1, whereby however a degree of overlap in the covering of the individual planes of the typical targets in the above requirement (namely, the total area of trim in the individual planes or layers taken together, less the extended area of the wide band camouflage netting) of about 20% to 30% of the netting area is necessary for normal direction of observation.

There is a difficulty when using a multi-layer camouflage netting of the invention in that the individual planes or layers must be tensioned individually under some circumstances (when the tensioning is other than horizontal), in order to ensure the spacings and the overlaps in the layers.

This is appropriately facilitated by at least the inner support net(s) being made of elastic filaments whereby the plane spacings are fixed. In another implementation of the invention, the trim itself consists of stretch-fabric, especially when no support net at all is provided, or only for part of the planes.

In certain tactical cases, one and the same camouflage netting must be adapted to various backgrounds. This is met in the state of the art by different color patterns being present on the face and back of a camouflage net. The same solution also may be applied to the characteristic shapes of the covered areas. In this instance the wide-band camouflage netting appropriately is of such a geometry as to include a central and substantially fully covered plane and in the structure resulting from the trim-covered and trim-bare areas in one plane being different from each other in the planes which are mostly widely apart.

If on the other hand in relation to a give background it is desired to change the colors while approximately keeping the same shapes by turning the netting, then this can be preferably be so realized that for the netting with two planes or layers the patterns of the bare areas are mutually complementary in the two planes or layers. To a distant observer therefore such a camouflage net will then appear the same, except for the contrast inversion.

Camouflaging in the range of the thermal inherent radiation (TIR) is made more difficult by the fact that on the basis of the manifold meteorological conditions, the spectral reflectance of the camouflaging material must be tightly fitted to nature in this range. Therefore a rise in temperature, for instance by direct solar irradiation, can be compensated only slightly by a low emission factor in the TIR.

As regards a multilayer netting, this applies only to the outside of the outer layers. All other areas can be selected lower in their emissivities, without the camouflage netting being revealed as an excessively cold spot. (As regards opaque bodies, the emission factor plus the spectral reflectance factor are unity).

As regards the lower planes, there always takes place a mixing of the apparent temperatures of the open space, of the layer above and of the true temperature. Thereby a larger variation in the true temperature for the same camouflaging effect is permitted. Furthermore the individual spots of the trim differ both in their emission factors and in their genuine temperature, whereby both contrast types, that is temperature contrast and emission contrast, are subjected to a dissolving of the area structures and hence the camouflage netting is well fitted to nature.

For a three-layer camouflage netting, the inside central layer for instance may be made of a material with high thermal reflectivity which will heat little even when subjected to thermal radiation and which furthermore reveals its temperature only slightly on account of its low emission factor when heated from other sources.

Parts of the effect being achieved by the plurality of planes or layers also can be obtained by using corrugated, nubbed, creped, embossed or shrunk material as trim. All of these surface structures achieve a distribution of possible directions of observation to the surface normal of the trim material in the same manner as in natural foliage. Furthermore the temperature of such an area more rapidly adapts to ambient (coolant-heater effect) on account of a better (larger surface) contact. In particular the inside layer of such a double or triple ply camouflage netting can be made of such a material that need not be cut or stamped and hence provides a complete screening of the radiation from the target which must be camouflaged.

The invention is discussed below in greater detail in relation to the embodiments shown in the drawing.

Figure 2:
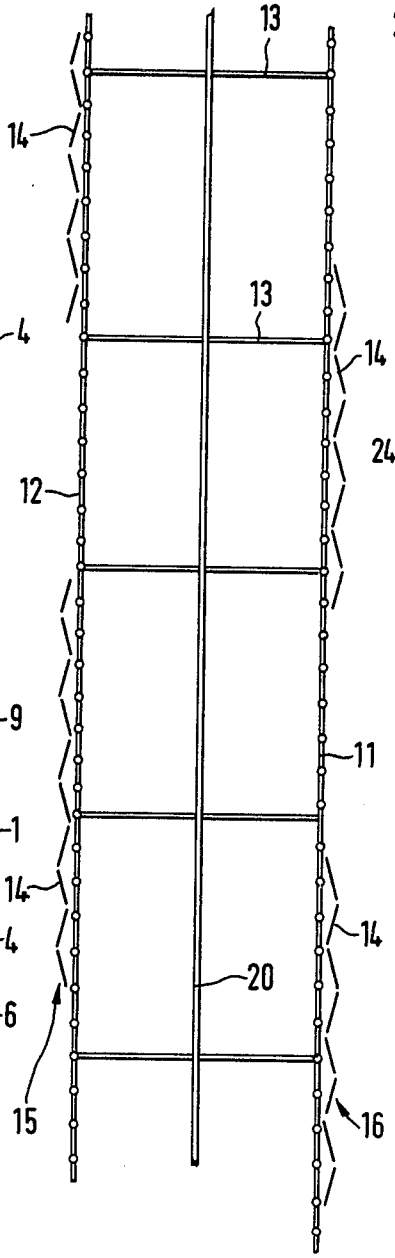
Figure 3:
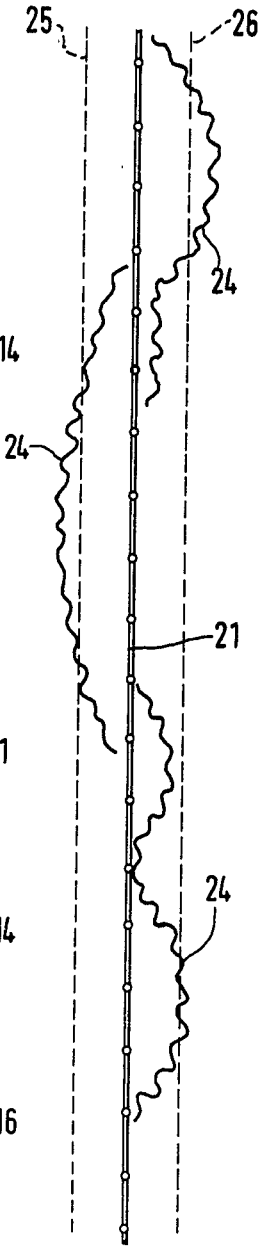

FIG. 1 is a wide-band camouflage net of the invention, for which the trim material is arranged in two planes and fixed to two support nets, FIG. 2 is an arrangement corresponding to FIG. 1, provision however being made between the two support nets for an inside or central third and practically fully covered layer, and FIG. 3 is a wide-band camouflage net, for which merely one layer is provided as a support net, the planes of trim being fixed to the opposite sides of said support net.

FIG. 1 shows a wide-band camouflage net 7 of the invention and consisting of two layers of support nets 1 and 2 which are kept apart by tapes or cords 3. Trim 4 is so mounted on the support nets that for the embodiment shown, it is arranged practically in two planes 5 and 6. The trim in a plane 5 or 6 does not fully cover this plane, rather it leaves some clear spaces. As a whole the trim is so arranged in the planes that for a direction of observation perpendicularly to the longitudinal direction of the planes 5 and 6, all of the surface of the wide-band camouflage netting appears covered.

FIG. 2 shows an embodiment of a wide-band camouflage netting corresponding to FIG. 1, with the reference numerals however being raised by 10, otherwise being the same. However the arrangement shown herein differs from that of FIG. 1 in that additionally a third layer 20 is provided. This central third layer 20 practically can be made fully closed and consist of a trim material, The advantage of such an arrangement is that the structure, that is the distribution of areas covered with or bare of trim can be selected to be wholly mutually independent in the two planes 15 and 16.

FIG. 3 shows how to make a camouflage net 21 with only one layer of support net on the basis of the present invention. In this embodiment, trim 24 is mounted in such a manner on the mutually opposite sides of the support net 21 that the trim is practically mounted in two planes 25 and 26. The planes 25 and 26 are located on either side of the support net. The wide-band camouflage netting shown is specially effective when the trim material is creped or corrugated, as in the embodiment shown, rather than cut or stamped. Preferably in this case large and mutually overlapping areas of trim will be fixed in such a manner on the opposite sides of the support net that under the effect of wind forces, these spots can lift far from the support net. Those sides of the trim spots which face toward the support net have an emission factor about $\frac{1}{2}$ in the range of the above cited atmospheric windows while the outsides have emission factors of about $\frac{3}{4}$ within said spectral range. The coloration in the optical range of the spectrum remains unaffected thereby.

We claim:

1. A camouflage net comprising two or more layers of a carrier net with garnishing stretch fabric materials spread out on said layers and so affixed on each of said layers as to effectively overlap at least partially from one of said layers to the other thus preventing any radiation perpendicular to said layers from penetrating said net with the average spacing of the layers held together by tapes or cords, the length of which defines the spacing between said layers.

2. A camouflage net as in claim 1, wherein the overlap of the garnishing stretch fabric material is approximately 20% over that needed to cover the net surface.

3. A camouflage net as in claim 1, wherein the emission factor of the garnishing stretch fabric material in the spectral region of thermal infrared radiation (TIR) is substantially higher on the outwardly directed sides than it is on the inwardly directed sides.

4. A camouflage net as in claim 1, wherein the garnishing stretch fabric material is disposed on or between said carrier nets.

5. A camouflage net as in claim 1, wherein the garnishing stretch fabric material is disposed in the respective layers in a self-supporting manner.

6. A camouflage net as in claim 1, wherein the maximum spacing between the layers of the carrier nets having thereon the garnishing stretch fabric material is defined, in each instance, by tie-strings or tie-ribbons.

7. A camouflage net as in claim 1, wherein the two superimposed carrier nets having thereon the garnishing stretch fabric material are joined together by means of elastically yielding strings or ribbons.

8. A camouflage net as in claim 1, wherein the carrier nets and the garnishing stretch fabric are made of elastically yielding material.

9. A camouflage net as in claim 1, wherein the garnishing stretch fabric material is of a material having an appearance selected from the group consisting of wavy, napped, crepe-like, embossed and shrunken.

* * * * *